US008209932B2

(12) United States Patent
Begur et al.

(10) Patent No.: US 8,209,932 B2
(45) Date of Patent: Jul. 3, 2012

(54) BACKSPLASH FOR AN APPLIANCE

(75) Inventors: Chidanand Begur, Hyderabad (IN); Sheena Leigh Ritchie, Shepherdsville, KY (US); Jorge Hinojosa, Queretaro (MX); Heather Ann Thomas, Louisville, KY (US)

(73) Assignee: General Electric Company, Schenectady, NY (US)

( * ) Notice: Subject to any disclaimer, the term of this patent is extended or adjusted under 35 U.S.C. 154(b) by 435 days.

(21) Appl. No.: 12/122,297

(22) Filed: May 16, 2008

(65) Prior Publication Data

US 2009/0282756 A1 Nov. 19, 2009

(51) Int. Cl.
*E04B 1/38* (2006.01)

(52) U.S. Cl. ..... 52/510; 52/506.01; 52/511; 52/36.5

(58) Field of Classification Search ..... 52/384, 52/385, 386, 387, 36.5, 506.01, 506.05, 506.08, 52/510, 511, 481.2, 36.4; 108/27, 42, 152, 108/148, 147.11; 312/140.3, 140.4, 281, 312/236

See application file for complete search history.

(56) References Cited

U.S. PATENT DOCUMENTS

| | | | | | |
|---|---|---|---|---|---|
| 1,981,674 | A | * | 11/1934 | Solomon | 312/281 |
| 2,082,241 | A | * | 6/1937 | Bennett | 52/387 |
| 2,106,315 | A | * | 1/1938 | Brooks et al. | 52/506.05 |
| 2,927,666 | A | * | 3/1960 | Braviak | 52/36.4 |
| 3,101,486 | A | * | 8/1963 | Tiller | 4/632 |
| 3,260,559 | A | * | 7/1966 | Newman et al. | 312/224 |
| 3,385,284 | A | * | 5/1968 | White | 126/37 R |
| 3,514,577 | A | * | 5/1970 | Dills et al. | 219/400 |
| 3,514,578 | A | * | 5/1970 | Dills | 219/400 |
| 3,634,983 | A | * | 1/1972 | Welch | 52/27.5 |
| 3,672,107 | A | * | 6/1972 | Santry et al. | 52/235 |
| 3,953,093 | A | * | 4/1976 | Hero | 312/245 |
| 4,051,789 | A | * | 10/1977 | Howitt | 108/152 |
| 4,074,635 | A | * | 2/1978 | Stauble | 110/259 |
| 4,133,507 | A | * | 1/1979 | Chervenak | 248/223.41 |
| 4,254,450 | A | * | 3/1981 | White et al. | 362/92 |
| 4,282,416 | A | * | 8/1981 | White | 219/756 |
| 4,313,043 | A | * | 1/1982 | White et al. | 219/757 |
| 4,329,003 | A | * | 5/1982 | Manchester | 312/245 |
| 4,347,795 | A | * | 9/1982 | Makinen | 108/152 |

(Continued)

FOREIGN PATENT DOCUMENTS

FR 2588028 A1 * 4/1987

(Continued)

OTHER PUBLICATIONS

Sharp, "Sharp Cooking Appliances", MW-06-090/11-2004, pp. 1-8.

*Primary Examiner* — Robert Canfield
*Assistant Examiner* — Matthew Gitlin
(74) *Attorney, Agent, or Firm* — Global Patent Operation; Douglas D. Zhang

(57) ABSTRACT

An adjustable height backsplash for an appliance such as a cooking range is disclosed. The backsplash includes an upper wall mount mountable to a wall; a lower wall mount mountable to the wall at a selectable distance from the upper wall mount; an upper faceplate mountable to the upper wall mount and including an upper front panel; and a lower faceplate mountable to the lower wall mount and including a lower front panel. After installation, the upper front panel and the lower front panel together substantially cover a continuous portion of the wall.

22 Claims, 5 Drawing Sheets

U.S. PATENT DOCUMENTS

| | | | | |
|---|---|---|---|---|
| 4,601,147 | A * | 7/1986 | Migliore | 52/275 |
| 4,621,001 | A * | 11/1986 | Bard | 428/49 |
| 4,916,875 | A * | 4/1990 | Kashiwagi | 52/302.3 |
| 5,312,178 | A * | 5/1994 | King | 312/140.4 |
| 5,417,020 | A * | 5/1995 | Dobija | 52/235 |
| 5,419,264 | A * | 5/1995 | Davis | 108/27 |
| 6,000,178 | A * | 12/1999 | Goodings | 52/235 |
| 6,070,536 | A * | 6/2000 | Cinkaj | 108/152 |
| 6,115,978 | A * | 9/2000 | Bastian et al. | 52/243.1 |
| 6,158,178 | A * | 12/2000 | Jeffers et al. | 52/220.7 |
| 6,421,974 | B1 * | 7/2002 | Whitehouse et al. | 52/510 |
| 6,471,311 | B1 * | 10/2002 | Snyder | 312/247 |
| 7,823,333 | B2 * | 11/2010 | Kim | 52/36.5 |
| 2002/0108330 | A1 * | 8/2002 | Yu et al. | 52/238.1 |
| 2004/0200166 | A1 * | 10/2004 | Guth | 52/378 |
| 2005/0204666 | A1 * | 9/2005 | Passeno | 52/384 |
| 2005/0246989 | A1 * | 11/2005 | Pringle et al. | 52/384 |
| 2006/0185283 | A1 * | 8/2006 | Lee | 52/384 |
| 2006/0185297 | A1 * | 8/2006 | Mei | 52/506.05 |

FOREIGN PATENT DOCUMENTS

| | | | |
|---|---|---|---|
| JP | 03132554 | A * | 6/1991 |
| JP | 03208952 | A * | 9/1991 |
| JP | 06294195 | A * | 10/1994 |

* cited by examiner

BACKSPLASH FOR AN APPLIANCE

BACKGROUND OF THE INVENTION

This invention relates generally to a backsplash for an appliance. More particularly, this invention relates to an adjustable height backsplash for an appliance such as a cooking range.

A cooking range typically includes a backsplash which is positioned at the rear of the cooking range housing and projects upward from the cook top. Such a backsplash has a number of uses. For example, it often includes controls for selectively operating the baking and broiling cavity or the oven. Sometimes it also includes controls for selectively operating the various surface cooking units on the cook top. Furthermore, the backsplash provides an easy-to-clean surface after a cooking spill occurs. To this end, it is often desirable that the backsplash has a very smooth, continuous/un-interrupted front surface.

FIG. 1 illustrates an exemplary freestanding gas range 100. The gas range 100 includes an outer body or housing 112 that has a generally rectangular shaped cook top 114. An oven, not shown in detail, is positioned below the cook top 114 and has a front-opening access door 116. An integral backsplash 118 extends upward from a rear edge 120 of the cook top 114 and contains various controls 119 for selectively operating heating elements 122 on the cook top 114 and/or heating elements in the oven. In some of today's kitchens, a cooking range is usually positioned adjacent to a wall and below or beneath a top vent hood. In such a configuration, it is often desirable to have a backsplash which essentially covers a continuous portion of the wall that extends from the cook top of the cooking range all the way to the top vent hood. However, the backsplash 118 of the gas range 100 usually is not high enough for this purpose.

In some of today's cooking ranges, the controls and other features are placed at the front of the cooking ranges. A configuration with front controls eliminates the need to provide a backsplash integrated with the cooking range. FIG. 2 illustrates an exemplary, freestanding gas range 200 with front controls and no integrated backsplash. The gas range 200 includes an outer body or housing 212 that has a generally rectangular shaped cook top 214. An oven, not shown in detail, is positioned below the cook top 214 and has a front-opening access door 216. A range control panel 218 is positioned between the access door 216 and the cook top 214 and contains various controls 219 for selectively operating heating elements 222 on the cook top 214 and the heating elements in the oven. The gas range 200 may also incorporate vents 226, 240 for venting gases from around the oven and/or for downdraft ventilation of surface burner gases.

The gas range 200 lacks an easy-to-clean backsplash. As a result, a consumer is left with using a separate backsplash. Of course, a tiled wall or a painted wall adjacent to the gas range 200 may be used as a backsplash for the gas range 200. However, in each of these instances the backsplash does not match the proximate gas range 200 in terms of material, color, etc. Furthermore, if a painted wall is used as a backsplash, it often lacks good cleanability. When a consumer desires a backsplash that matches the proximate gas range 200, a custom-made backsplash is often required because the height or distance between the cooking range 200 and a top object such as a vent hood varies from home to home.

SUMMARY OF THE INVENTION

As described herein, preferred embodiments of the invention overcome one or more of the above or other disadvantages known in the art.

One aspect of the invention relates to an adjustable height backsplash for an appliance. The backsplash includes an upper wall mount mountable to a wall, a lower wall mount mountable to the wall at a predetermined or selected distance (predetermined or selected distance means the distance between the upper wall mount and the lower wall mount is determined at the time of installation, not at the time of manufacture) from the upper wall mount, an upper faceplate, and a lower faceplate. The lower faceplate is mountable to the lower wall mount and includes a lower front panel. The upper faceplate is mountable to the upper wall mount and includes an upper front panel. The upper faceplate is configured to receive at least a portion of the lower faceplate so that the height of the backsplash is adjustable. After installation, the upper front panel and the lower front panel together substantially cover a continuous portion of the wall.

Another aspect of the invention relates to an arrangement of a cooking range and an adjustable height backsplash. The cooking range is positioned adjacent to a wall and beneath a top object, such as for example, a range hood, or combination oven and hood. The adjustable height backsplash includes an upper wall mount mounted to the wall and positioned between the top object and the cooking range, a lower wall mount mounted to the wall and disposed at a predetermined distance from the upper wall mount, an upper faceplate, and a lower faceplate. The lower faceplate is mounted to the lower wall mount and includes a lower front panel. The upper faceplate is mounted to the upper wall mount and includes an upper front panel. The upper faceplate is configured to receive at least a portion of the lower faceplate so that the height of the backsplash is adjustable. The upper front panel and the lower front panel together substantially cover a continuous portion of the wall that extends from the top rear edge of the cooking range to the top object.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and that, unless otherwise indicated, they are merely intended to conceptually illustrate the structures and procedures described herein.

BRIEF DESCRIPTION OF THE DRAWINGS

The following figures illustrate preferred embodiments of the invention. In the drawings.

DETAILED DESCRIPTION OF THE PREFERRED EMBODIMENTS OF THE INVENTION

While the preferred embodiments of the invention are herein described in connection with a gas range, as set forth more fully below, it is contemplated that the described preferred embodiments of the invention may find utility in other appliances where a backsplash is desired but not provided. The description herein below therefore sets forth only by way of illustration rather than limitation, and is not intended to limit the practice of the herein described preferred embodiments of the invention.

Figure 1:
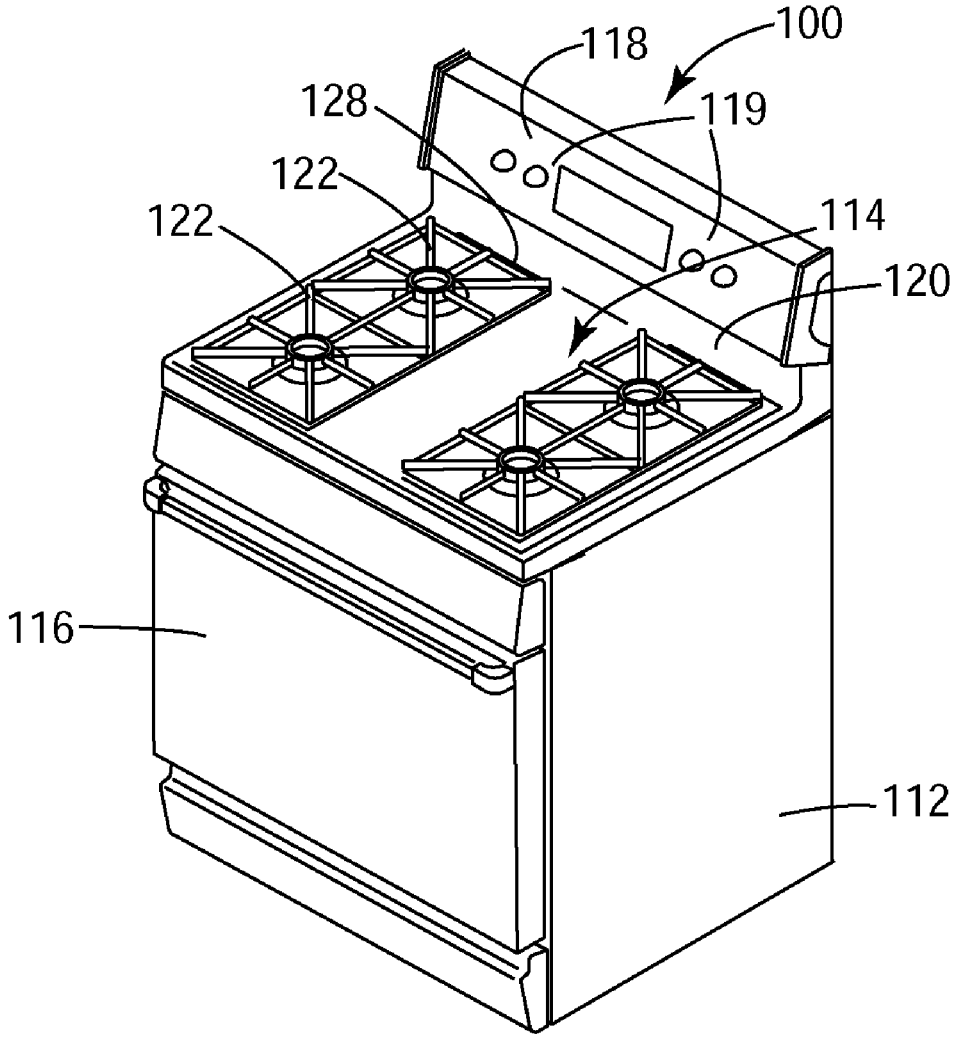
FIG. 1 Prior Art
FIG. 1 is a perspective view of a known gas range.
Figure 2:
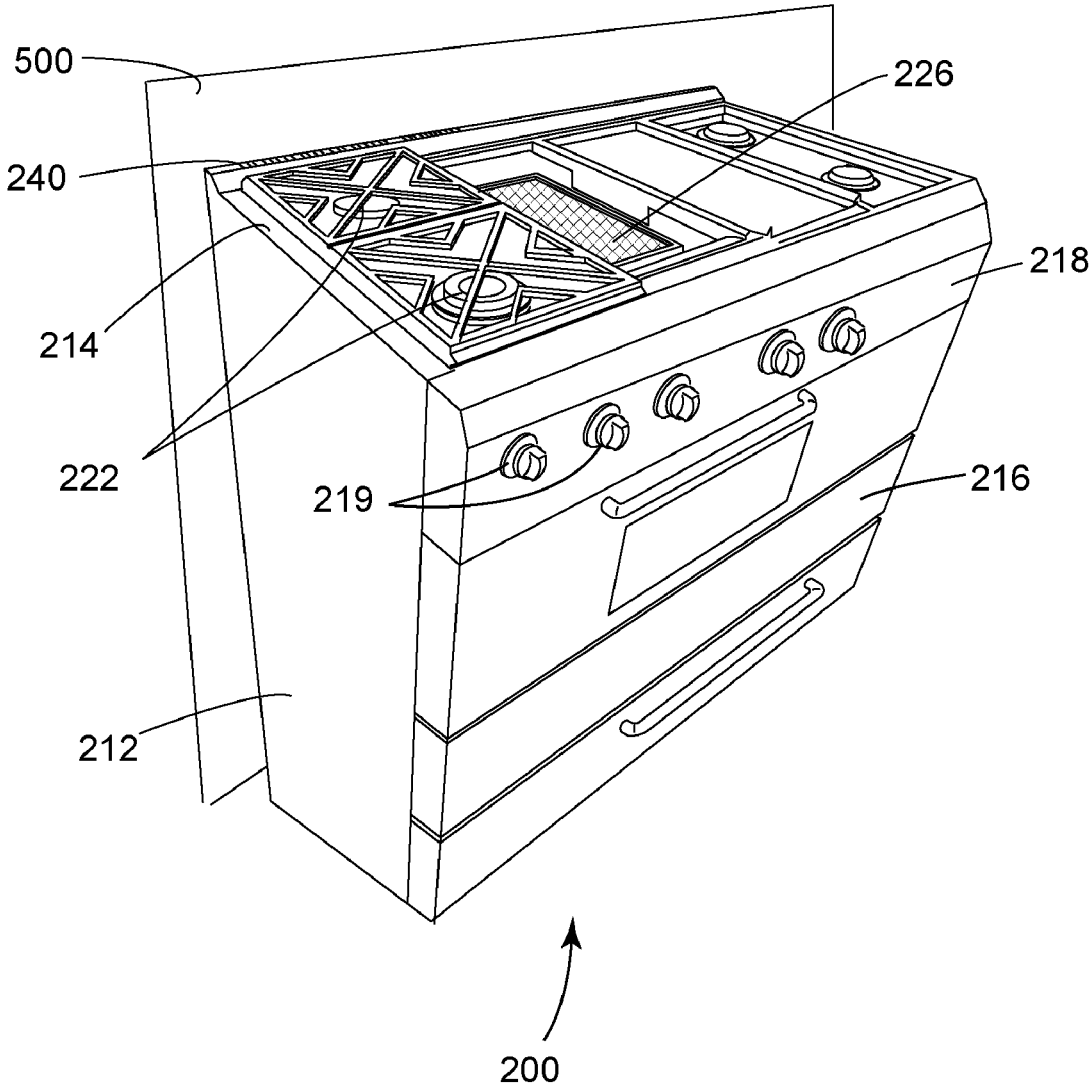
FIG. 2 Prior Art
FIG. 2 is a perspective view of another known gas range.
Figure 3:
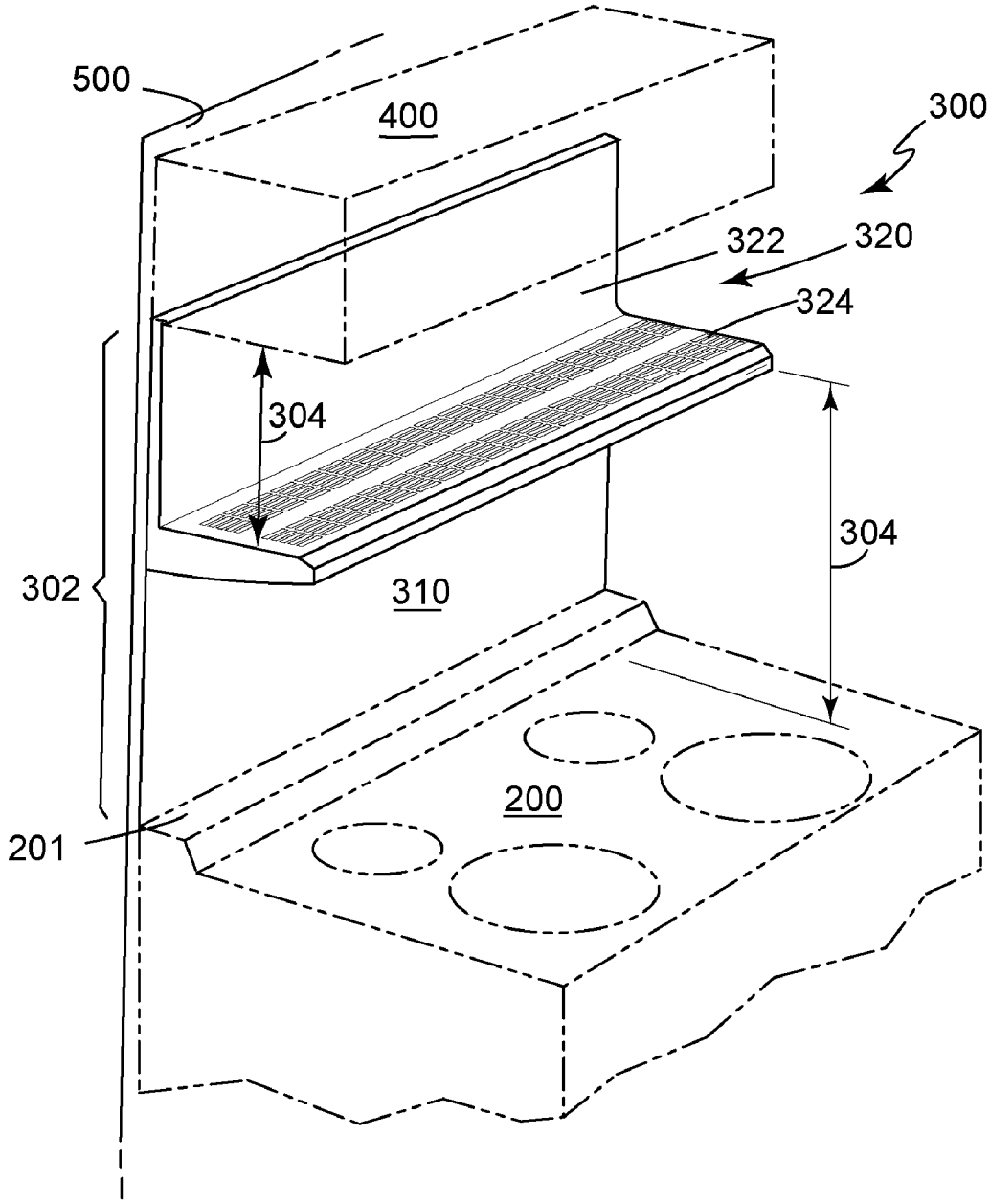
FIG. 3 is a perspective view of an assembled backsplash according to an exemplary embodiment of the invention.

A preferred embodiment of a backsplash of the invention is generally designated by reference numeral 300 in FIG. 3. The overall height 302 of the backsplash 300 may be adjusted to completely fill or cover the gap between a range top 201 of the range 200 and a top object such as a vent hood 400. However, the height 304 between the vent hood 400 and a shelf such as a warming shelf 324 is often constant. The warming shelf 324 and an upper member 322 form an upper faceplate 320. A lower faceplate 310 is positioned below/beneath and/or under the upper faceplate 320 and covers the space between the range top 201 and the warming shelf 324. The warming shelf 324 provides a place for placement of items such as pots or other vessels for keeping food warm. By adjusting the amount of the lower faceplate 310 under the upper faceplate 320, the height 304 may be adjusted or changed to ensure a complete coverage of the space between the range top 201 and the vent hood 400 by the backsplash 300.

The gap between the range top 201 and the vent hood 400 varies by installation. Because there is a wide range of variables affecting the placement of the range 200 and the vent hood 400, different installations may result in different heights 302, 304. Therefore, fixed height backsplash would not provide a complete coverage and may create a gap at the top or bottom of such fixed height backsplash in relation to the vent hood 400 or the range top 201 of the range 200.

The distance 304 from the warming shelf 324 to the vent hood 400 is often made fixed so cooking vessels or plates placed on the warming shelf 324 can be kept warm by a lamp (not shown) of the vent hood 400.

As shown in FIGS. 3-7, where like reference numerals are used to denote like elements, the backsplash 300 includes four main components: a lower wall mount 340 which is fixable to the wall 500 (see FIG. 3; the wall 500 refers to the wall of the room in which the range 200 is installed) above the gas range 200; the lower faceplate 310 which is mountable over the lower wall mount 340; an upper wall mount 350 which is fixable to the wall 500 below or beneath the vent hood 400; and the upper faceplate 320 which is mountable over the upper wall mount 350.

Figure 4:
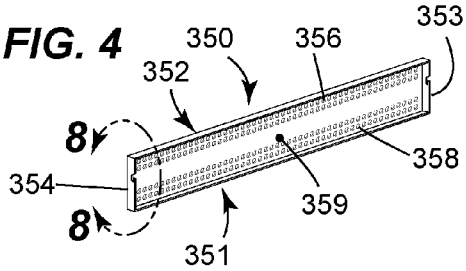
FIG. 4 is a perspective view of the upper wall mount of the backsplash of FIG. 3.
Figure 8:
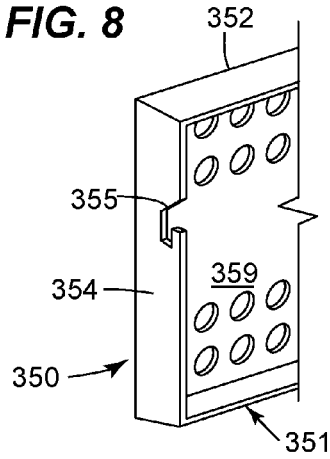
FIG. 8 is an enlarged cutaway depicted in FIG. 4.

As illustrated in FIG. 4, the upper wall mount 350 is generally rectangular in shape and has a top edge 352 and a bottom edge 351. During installation, the top edge 352 is placed adjacent to the vent hood 400. A plurality of upper holes 356 and a plurality of lower holes 358 are provided in the back panel 359 of the upper wall mount 350 for securing the top wall mount 350 to the wall 500 by using known fasteners, such as but not limited to, screws, lag bolts, drywall fixtures or hooks. The upper wall mount 350 has two side panels 353, 354 which extend outward from the respective side edges of the back panel 359. Each of the side panels 353, 354 is preferably substantially perpendicular to the back panel 359. Furthermore, each of the side panels 353, 354 preferably projects away from the wall 500 when installed. As illustrated in FIG. 8, each of the side panels 353, 354 has an opening such as groove 355. Each groove 355 is configured to receive a respective pin 370 (see FIG. 10) on the inside surface of the respective side panel 321 of the upper faceplate 320. As shown in FIG. 8, each groove 355 preferably extends downward and inward from the outer edge of the respective side panel 353, 354 so that when the upper faceplate 320 is mounted on the upper wall mount 350, the pins 370 would not accidentally slip or fall out of the respective grooves 355. This ensures an easy and secure connection between the upper faceplate 320 and the upper wall mount 350.

Figure 5:
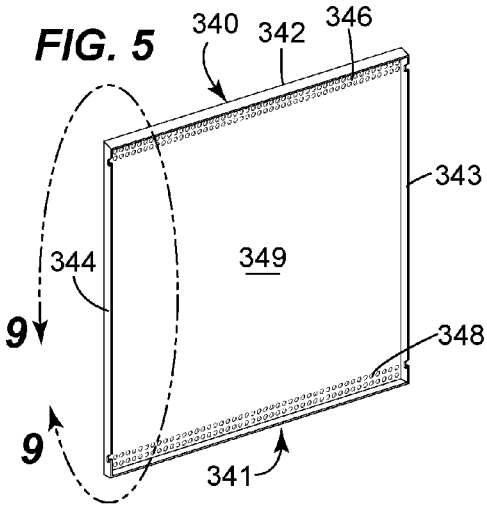
FIG. 5 is a perspective view of the lower wall mount of the backsplash of FIG. 3.
Figure 9:
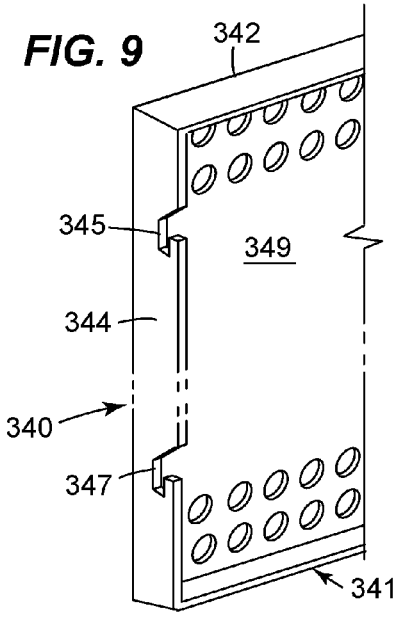
FIG. 9 is an enlarged cutaway depicted in FIG. 5.

As shown in FIG. 5, the lower wall mount 340 is generally rectangular in shape and has a top edge 342 and a bottom edge 341. During installation the bottom edge 341 is placed proximate to or adjacent to the gas range 200. A plurality of upper holes 346 and a plurality of lower holes 348 are provided in the back panel 349 of the lower wall mount 340 for securing the lower wall mount 340 to the wall 500 by using known fasteners, such as but not limited to, screws, lag bolts, drywall fixtures or hooks. The lower wall mount 340 has two side panels 343, 344 which extend outward from the respective side edges of the back panel 349. Preferably, each of the side panels 343, 344 is disposed generally perpendicular to the back panel 349. Furthermore, each of the side panels 343, 344 preferably projects away from the wall 500 when installed. As shown in FIG. 9, each of the side panels 343, 344 has openings such as grooves 345, 347. The grooves 345, 347 are configured to receive respective pins 370' (see FIG. 11) on the inside surfaces of side panels 314 of the lower faceplate 310. As shown in FIG. 9, each groove 345, 347 preferably extends downward and inward from the outer edge of the respective side panel 343, 344 so that when the lower faceplate 310 is mounted on the lower wall mount 340, the pins 370' would not accidentally slip or fall out of the respective grooves 345, 347. This ensures an easy and secure connection between the lower faceplate 310 and the lower wall mount 340.

Figure 6:
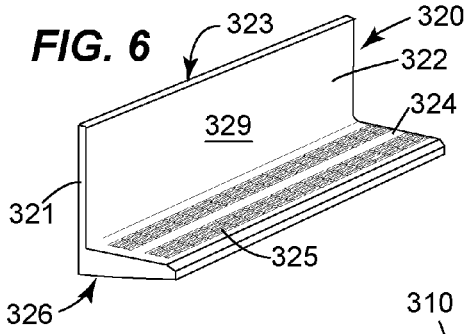
FIG. 6 is a perspective view of the upper faceplate of the backsplash of FIG. 3.

As shown in FIG. 6, the upper faceplate 320 includes the upper member 322 and the warming shelf 324 which is attached to the upper member 322, preferably near the bottom edge thereof, and extends outward therefrom. The warming shelf 324 provides a location for placing items such as cooking vessels or plates so that they are kept warm by a warming device such as a lamp of the vent hood 400 during cooking of other foods. The warming shelf 324 is attached to the upper member 322 during manufacture to provide a seamless appearance. Alternatively, the warming shelf 324 may be attached to the upper member 322 during installation by known fastening devices, such as but not limited to, bolts, screws or hook and grove, in a known manner. Preferably, the warming shelf 324 has a plurality of through holes 325 so that the weight of the warming shelf 324 is reduced and/or the heat from the cooking operation of the range below will not be substantially trapped under the warming shelf 324.

The upper member 322 includes an upper front panel 329 which is generally rectangular in shape and occupies a plane which is generally parallel to the wall 500 when installed. The upper front panel 329 may be formed of stainless steel or painted to match the proximate gas range 200. The upper member 322 has an open bottom 326 so that when installed at least the top portion of the lower faceplate 310 can enter into the upper faceplate 320 and be disposed behind the upper faceplate 320. Preferably the upper member 322 has a top panel 323 which extends outward from the top edge of the upper front panel 329. The top panel 323 is generally straight and is disposed substantially adjacent to the vent hood 400 after installation.

The upper member 322 also includes two side panels 321 which extend outward from the respective side edges of the upper front panel 329. Preferably, the top panel 323 and the side panels 321 are generally perpendicular to the upper front panel 329 and cover the gap between the upper front panel 329 and the wall 500 after the upper faceplate 320 is mounted on the upper wall mount 350. The top panel 323 and the side panels 321 are preferably made of the same material as the upper front panel 329. At locations 372, the pins 370 are attached to the respective inside surfaces of the side panels 321 (see FIG. 10). The pins 370 are received in the respective grooves 355 of the upper wall mount 350 after the upper faceplate 320 is mounted on the upper wall mount 350. Because of the pins 370 and grooves 355, the upper front panel 329 is smooth and uninterrupted and does not have any visible fastener.

Figure 7:
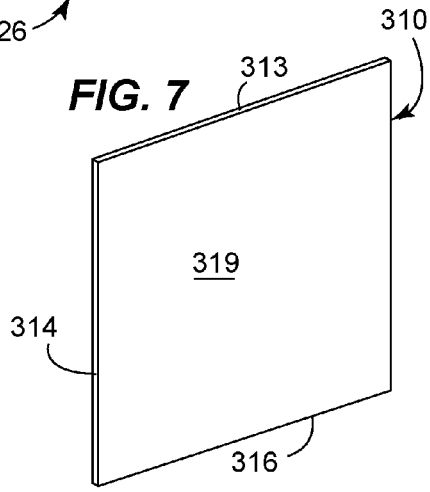
FIG. 7 is a perspective view of the lower faceplate of the backsplash of FIG. 3.

As clearly shown in FIG. 7, the lower faceplate 310 includes a lower front panel 319 which is generally rectangular in shape and occupies a plane which is generally parallel to the wall 500 after installed. The lower front panel 319 may be made of stainless steel or painted to match the proximate gas range 200. The lower faceplate 310 has a bottom edge 316 which is generally straight and is adjacent to the range top 201 after installed.

The lower faceplate 310 preferably also includes a top panel 313 and a bottom panel 317 (see FIG. 11), both of which extend outward from the top edge and the bottom edge of the lower front panel 319, respectively. Preferably, the top panel 313 and the bottom panel 316 are generally perpendicular to the lower front panel 319. The lower faceplate 310 further includes two side panels 314 which extend outward from the respective side edges of the lower front panel 319. Preferably, the side panels 314 are substantially perpendicular to the lower front panel 319. The top panel 313, the bottom panel 317, and the side panels 311 are preferably made of the same material as the lower front panel 319. At locations 372', 373, pins 370' are attached to the respective inside surfaces of the side panels 314 (see FIG. 11). Pins 370' are received in the respective grooves 345, 347 of the lower wall mount 340 after the lower faceplate 310 is mounted on the lower wall mount 340. Because of the pins 370' and grooves 345, 347, the lower front panel 319 is smooth and un-interrupted and does not have any visible fasteners.

Figure 10:
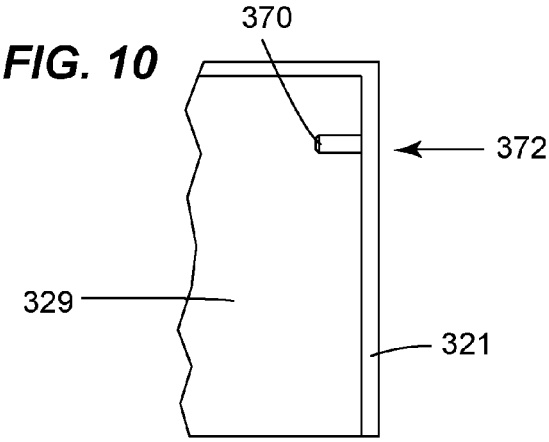
FIG. 10 is a partial, back view of the upper faceplate of the backsplash of FIG. 3.
Figure 11:
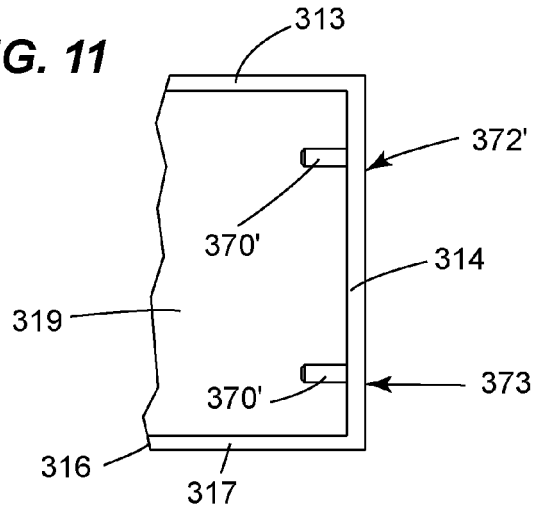
FIG. 11 is a partial, back view of the lower faceplate of the backsplash of FIG. 3.
Figure 12:
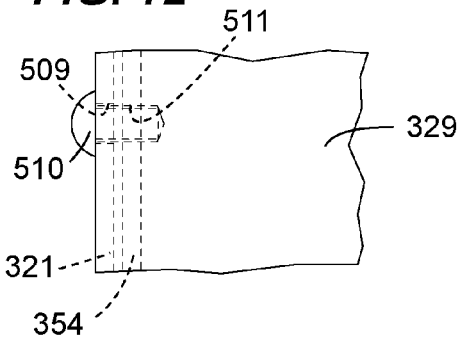
FIG. 12 is a partial front view of the backsplash of FIG. 3.
Figure 13:
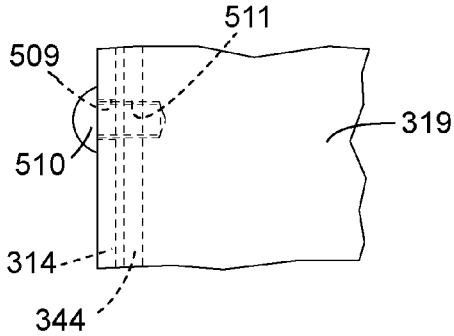
FIG. 13 is another partial front view of the backsplash of FIG. 3.

The pins 370, 370' may be configured as shown in FIGS. 10 and 11 or may be configured in any other known fashion to cooperate with the grooves 345, 347, 355. Furthermore, instead of using the pins 370, 370', through holes 509 permitting insertion of screws 510 (see FIGS. 12 and 13) may be used while the respective grooves 345, 347, 355 may be replaced by through holes, such as threaded holes 511 (see FIGS. 12 and 13).

As illustrated in FIGS. 4-7, the upper faceplate 320 has a height which is substantially greater than that of the upper wall mount 350 so that when the upper faceplate 320 is mounted on the upper wall mount 350 with its top panel 323 being supported by the upper wall mount 350, there is sufficient space inside the upper faceplate 320 for receiving at least a top portion of the lower faceplate 310. In this configuration, the lower faceplate 310 covers the lower wall mount 340 and the upper faceplate 320 covers the upper wall mount 350 and the at least top portion of the lower faceplate 310. On the other hand, preferably the lower faceplate 310 has a height which is just slightly greater than that of the lower wall mount 340. Additionally, preferably, the bottom panel 317 of the lower faceplate 310 has openings such as through holes (not shown), and the bottom edge 341 of the lower wall mount 340 has corresponding through holes such as threaded holes (not shown) so that the bottom panel 317 can be attached to the bottom edge 341 by fasteners such as screws.

When installed, the backsplash 300 can have a maximum height which is substantially equal to the combined heights of the upper faceplate 320 and the lower faceplate 310. The backsplash 300 can have a minimum height which is substantially equal to the combined heights of the upper wall mount 350 and the lower faceplate 310. The height of the backsplash 300 may be adjusted to any value between the maximum and minimum heights by adjusting the distance between the upper wall mount 350 and the lower wall mount 340. The width of the backsplash 300 is determined by the standard width of the associated cooking range. The standard width of a cooking range is 24, 30, 36, or 48 inches.

While there has been shown, described, and pointed out fundamental novel features of the present invention as applied to preferred embodiments thereof, it will be understood that various omissions and substitutions and changes in the apparatus described, in the form and details of the devices disclosed, and in their operation, may be made by those skilled in the art without departing from the spirit of the present invention. It is expressly intended that all combinations of those elements that perform substantially the same function in substantially the same way to achieve the same results are within the scope of the invention. Substitutions of elements from one described embodiment to another are also fully intended and contemplated.

What is claimed is:

1. An adjustable height backsplash for an appliance positioned proximate a wall, the backsplash comprising:

an upper wall mount mountable to the wall, the upper wall mount comprising a back panel and two side panels, each of the two side panels extending outward from a respective side edge of the back panel;

a lower wall mount mountable to the wall and separated by a selected vertical distance from the upper wall mount;

an upper faceplate mountable to the upper wall mount, the upper faceplate comprising an upper front panel and two side panels extending outward from the upper front panel towards the wall and over the side panels of the upper wall mount; and a lower faceplate mountable to the lower wall mount, wherein after installation, the upper faceplate and the lower faceplate together substantially cover a continuous portion of the wall.

2. The backsplash of claim 1, wherein the upper faceplate is configured to receive at least a top portion of the lower faceplate, and wherein the upper faceplate has a height greater than a height of the upper wall mount.

3. The backsplash of claim 2, having a maximum height which is substantially equal to a combination of the height of the upper faceplate and a height of the lower faceplate.

4. The backsplash of claim 2, having a minimum height which is substantially equal to a combination of the height of the upper wall mount and a height of the lower faceplate.

5. The backsplash of claim 1, wherein the upper faceplate further comprises a shelf extending outward from the upper front panel.

6. The backsplash of claim 1, wherein at least one of the upper wall mount and the lower wall mount has a plurality of through holes for mounting the at least one of the upper wall mount and the lower wall mount to the wall.

7. The backsplash of claim 1, wherein each side panel of the upper faceplate has an opening for mounting the upper faceplate to the upper wall mount.

8. The backsplash of claim 1, wherein at least one of the upper faceplate and the lower faceplate comprises a front panel having no visible fastener.

9. The backsplash of claim 1, wherein the lower faceplate comprises a lower front panel and two side panels extending outward from the lower front panel towards the wall, each side panel having an opening for mounting the lower faceplate to the lower wall mount.

10. An adjustable height backsplash for covering a gap between a cooking range disposed adjacent to a wall and a top object disposed on the wall above the range, the adjustable height backsplash comprising:

an upper wall mount mounted to the wall adjacent the top object, the upper wall mount comprising a back panel and two side panels, each of the two side panels extending outward from a respective side edge of the back panel;

a lower wall mount mounted to the wall proximate to the range and separated from the upper wall mount by a selected vertical distance;

an upper faceplate mounted to the upper wall mount and comprising an upper front panel and two side panels extending outward from the upper front panel towards the wall and over the two side panels of the upper wall mount; and a lower faceplate mounted to the lower wall mount and comprising a lower front panel, wherein the upper faceplate is configured to receive a top portion of the lower faceplate inside the upper faceplate, to enable the upper front panel and the lower front panel together to extend between the cooking range and the top object, substantially covering a continuous portion of the wall which extends from the cooking range to the top object.

11. The backsplash of claim 10, wherein the upper faceplate has a height greater than a height of the upper wall mount.

12. The backsplash of claim 11, wherein the backsplash has a maximum height which is substantially equal to a combination of the height of the upper faceplate and a height of the lower faceplate.

13. The backsplash of claim 11, wherein the backsplash has a minimum height which is substantially equal to a combination of the height of the upper wall mount and a height of the lower faceplate.

14. The backsplash of claim 10, wherein the upper wall mount has a plurality of through holes for mounting the upper wall mount to the wall.

15. The backsplash of claim 10, wherein the lower wall mount has a plurality of through holes for mounting the lower wall mount to the wall.

16. The backsplash of claim 10, wherein each side panel of the upper faceplate has an opening for mounting the upper faceplate to the upper wall mount.

17. The backsplash of claim 10, wherein the lower faceplate further comprises two side panels extending outward from the lower front panel towards the wall, each side panel having an opening for mounting the lower faceplate to the lower wall mount.

18. The backsplash of claim 10, wherein at least one of the upper front panel and the lower front panel has no visible fastener.

19. The backsplash of claim 10, wherein the upper faceplate further comprises a shelf extending outward from the upper front panel.

20. The backsplash of claim 10, wherein each of the two side panels comprises a pin receiver that extends downward and inward from an outer edge of the side panel.

21. The backsplash of claim 10, wherein the lower wall mount comprises a back panel and two side panels that extend outward from the respective side edges of the back panel.

22. The backsplash of claim 21, wherein the lower faceplate comprises a front panel and two side panels extending outward from respective edges of the front panel towards the wall over the respective side panels of the lower wall mount.

* * * * *